US008806857B2

(12) United States Patent
Shaw et al.

(10) Patent No.: US 8,806,857 B2
(45) Date of Patent: Aug. 19, 2014

(54) DEVICE AND METHOD FOR REMOVING CARBON DIOXIDE FROM MOTOR VEHICLE EXHAUST

(76) Inventors: Mark D. Shaw, Ponte Vedra Beach, FL (US); J. Tad Heyman, Atlantic Beach, FL (US)

( * ) Notice: Subject to any disclaimer, the term of this patent is extended or adjusted under 35 U.S.C. 154(b) by 883 days.

(21) Appl. No.: 12/930,907

(22) Filed: Jan. 19, 2011

(65) Prior Publication Data

US 2011/0185705 A1 Aug. 4, 2011

Related U.S. Application Data

(60) Provisional application No. 61/336,289, filed on Jan. 20, 2010.

(51) Int. Cl.
*F01N 3/00* (2006.01)
*F01N 1/00* (2006.01)
*F01N 3/021* (2006.01)

(52) U.S. Cl.
CPC ..... *F01N 3/021* (2013.01)
USPC ..... 60/297; 60/274; 60/276; 60/324

(58) Field of Classification Search
USPC ..... 60/274, 287, 288, 297, 311, 324, 276, 60/292
See application file for complete search history.

(56) References Cited

U.S. PATENT DOCUMENTS

| | | | |
|---|---|---|---|
| 1,522,111 | A | 1/1925 | Franck-Philipson |
| 3,633,343 | A | 1/1972 | Mark |
| 3,722,189 | A | 3/1973 | Tourtellotte |
| 6,387,845 | B1 | 5/2002 | Masahiro et al. |
| 6,866,702 | B2 | 3/2005 | Mitsuda |
| 6,966,179 | B2 * | 11/2005 | Onodera et al. ..... 60/295 |

* cited by examiner

*Primary Examiner* — Thomas Denion
*Assistant Examiner* — Diem Tran
(74) *Attorney, Agent, or Firm* — Thomas C. Saitta

(57) ABSTRACT

A method and device for removing a minor portion of carbon dioxide from the exhaust gases of a motor vehicle, wherein less than 20 percent of the carbon dioxide is removed, and further wherein exhaust flow is not impeded such that there is no significant reduction in efficiency of the motor itself.

6 Claims, 2 Drawing Sheets

FIG. 1
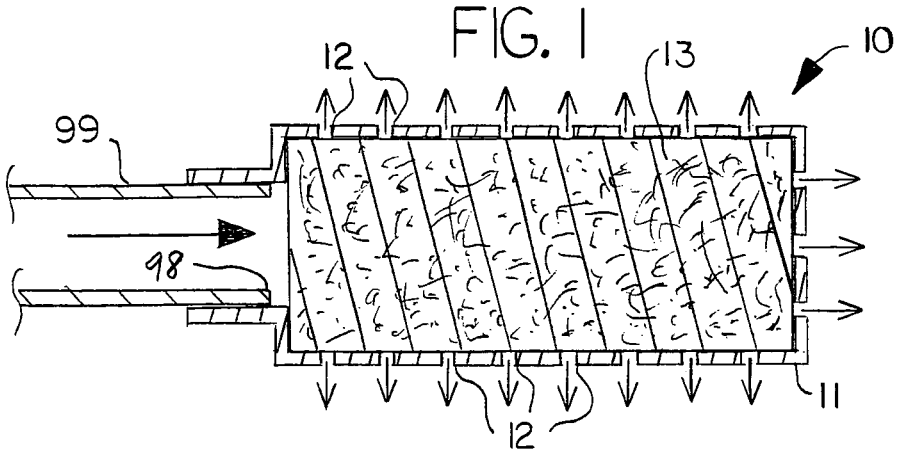
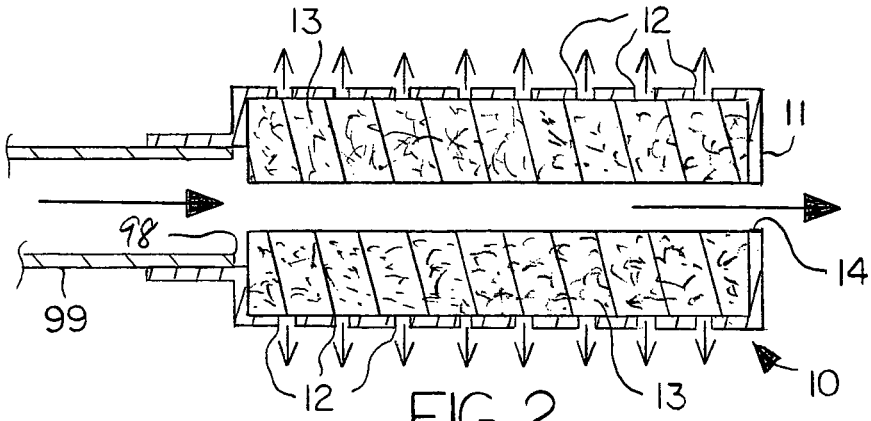
FIG. 2
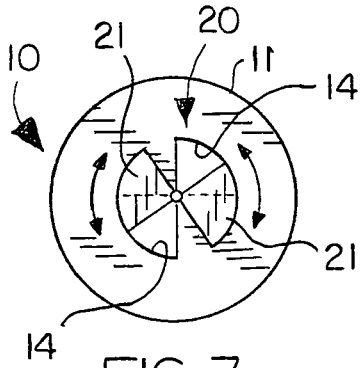
FIG. 3

DEVICE AND METHOD FOR REMOVING CARBON DIOXIDE FROM MOTOR VEHICLE EXHAUST

This application claims the benefit of U.S. Provisional Patent Application Ser. No. 61/336,289, filed Jan. 20, 2010.

BACKGROUND OF THE INVENTION

This invention relates generally to the field of methods and devices that are used to remove carbon dioxide from gas streams, and in particular relates to devices and methods for removing carbon dioxide from motor vehicle exhaust gases.

Carbon dioxide is a byproduct of hydrocarbon fuel combustion, such as the burning of gasoline to power motor vehicles. Carbon dioxide emission from motor vehicles is a major pollution problem and is considered to be a prime factor in global warming. Efforts have been made to eliminate or severely reduce the amount of carbon dioxide passing into the atmosphere, but to date such efforts have met with limited success. One approach in attacking the carbon dioxide emissions problem has been to provide a carbon dioxide absorbing filter as part of the motor vehicle exhaust assembly, typically by mounting the carbon dioxide filter to or within the exhaust pipe of the vehicle. A major problem with this attempted solution is that the devices are designed to absorb virtually all of the carbon dioxide produced in the combustion process, which usually results in excessive reduction of the exhaust flow, thereby impeding the efficiency of the motor.

It is an object of this invention to address the problem of carbon dioxide emissions by providing a device and method that removes only a minor amount of the carbon dioxide from the exhaust gas, such as less than about 20 percent, with the device structured such that the exhaust flow is not reduced and engine performance is not adversely affected. In this manner the total amount of carbon dioxide emissions from motor vehicles is significantly reduced without encountering the problems associated with earlier solutions.

SUMMARY OF THE INVENTION

The invention comprises a device and method for removing carbon dioxide from the exhaust gas of a motor vehicle, wherein the exhaust flow rate is not significantly reduced such that the efficiency of the engine is not adversely affected, only a minor portion of carbon dioxide emissions, preferably less than about 20 percent, being removed from the exhaust flow. The device comprises an absorbent filter device that is mounted to the exhaust pipe of a conventional motor vehicle exhaust system, preferably as an after-market device installed by removing a portion of the tail pipe and mounting the absorbent filter device to the remaining portion of the tail pipe. The filter may comprise any carbon dioxide absorbent material that is suitable for use in a motor vehicle exhaust environment, taking into account temperature, humidity and other factors.

In one embodiment of the invention, all of the exhaust gas is passed through the carbon dioxide absorbent material of the filter device, which is structured such that the flow rate is not significantly reduced and only about 20 percent or less of the carbon dioxide is absorbed, the remainder passing out into the atmosphere. In another embodiment of the invention, some or most of the exhaust gas from the motor is allowed to pass directly from the filter device without encountering the carbon dioxide absorbent material. In still another embodiment, the filter device is provided with a mechanism allowing the amount of exhaust gas directed through the carbon dioxide filter material and the amount of exhaust gas bypassing the filter material to be adjusted.

BRIEF DESCRIPTION OF THE DRAWINGS

FIG. 1 is a cross-sectional view of a possible embodiment of the exhaust filter device, wherein all of the exhaust gas passes through the filter material.

FIG. 2 is a cross-sectional view of another possible embodiment of the exhaust filter device, wherein the major portion of exhaust gas bypasses the filter material.

FIG. 3 is an end view of another possible embodiment of the exhaust filter device, wherein an adjustable valve is provided to control the amount of exhaust gas bypassing the filter material.

DETAILED DESCRIPTION OF THE INVENTION

Figure 4:
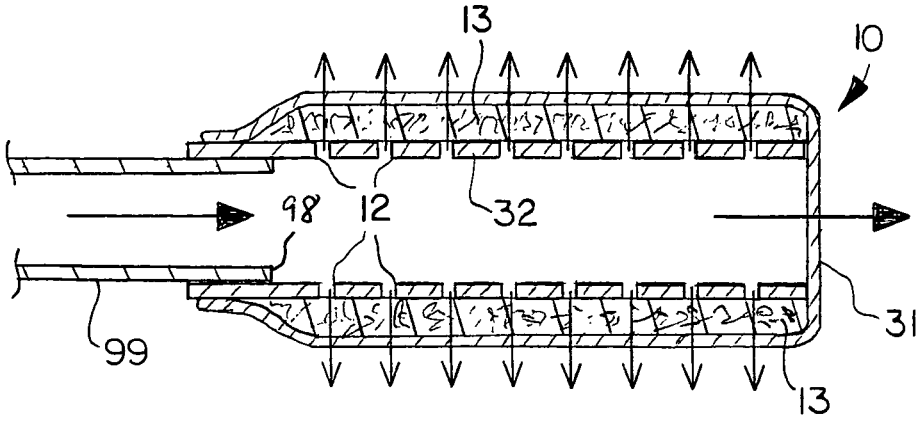
FIG. 4 is a cross-sectional view of another possible embodiment of the exhaust filter device, wherein the filter material is retained within a fabric material.

With reference to the drawings, the method and device will now be described in detail with regard for the preferred embodiments and best mode. In general, the invention is a method of removing a minor portion of carbon dioxide from motor vehicle exhaust gases produced as a byproduct of hydrocarbon combustion, and a device structured to remove a minor portion of carbon dioxide from motor vehicle exhaust gases produced as a byproduct of hydrocarbon combustion, wherein the flow rate of exhaust gas is not significantly impaired to the point of interfering with the efficient operation of the engine.

One possible embodiment is illustrated in FIG. 1, which illustrates carbon dioxide absorbing filter device 10 mounted onto the end of a motor vehicle exhaust pipe 99. Exhaust pipe 99 may be a horizontal member or a vertical member, and comprises an exit opening 98 having a diameter defining an open area. The filter device 10 comprises a housing 11, a plurality of apertures 12 and a quantity of carbon dioxide absorbing filter material 13. The filter material 13 may comprise a variety of known carbon dioxide absorbent filter materials, alone or in combination, such as for example $SiO_2$, $Al_2O_3$, $Fe_2O_2$, MgO, $Na_2O$, $SO_3$, lithium silicates, etc. The filter material 13 may be present in shaped block form or in particulate form retained within gas permeable receptacles (not shown), such as for example wire mesh or fabric.

The filter material 13 is provided in a manner such that only a minor portion of the carbon dioxide in the exhaust gas passing through the filter material 13 is absorbed (or adsorbed, as the case may be). Preferably less than about 20 percent of the carbon dioxide contained within the exhaust gas is removed, and most preferably only about 5 to 10 percent of the carbon dioxide is removed. Furthermore, it is imperative that the exhaust flow be minimally impeded so as not to affect the efficiency of the motor. This may be accomplished in several ways, such as by providing a block filter material 13 having a large proportion of passageways, i.e., a block filter material 13 that is relatively porous to gases. Alternatively, particulate filter material 13 may be loosely packed within its receptacle, again such that the overall device is relatively porous to the exhaust gases. The size and number of apertures 12 chosen take into consideration the impeding effect of the filter material 13 on gas flow, such that the exhaust flow rate of exhaust gases passing through filter device 10 compared to the original flow rate is not reduced. Thus, for example, for a motor vehicle having an exhaust flow rate of approximately 30 CFM (cubic feet per minute) emitting from an exhaust pipe 99 having an exit opening 98 with a diameter of approximately 4 inches, the housing 11 may be provided having a diameter of approximately 6 inches and having sufficiently sized and numbered apertures 12 such that the combined open area of the apertures 12 for exhaust gas flow from the housing 11 exceeds the approximate 12.56 square inch open area of the 4 inch diameter exhaust pipe 99. In this manner any reduction in flow resulting from passage of gas through the filter material 13 is compensated for by the increase in the amount of open area in housing 11, such that the original 30 CFM flow rate is maintained.

In an alternative embodiment shown in FIG. 2, the filter housing 11 may be provided with a relatively large exit port 14 that corresponds to a relatively large bore 15 positioned within the filter material 13. The exit port 14 defines an open area of greater dimension than any of said apertures 12 and of lesser dimension than the open area of the exit opening 98 of the exhaust pipe 99. With this structure, a large portion of the exhaust gas passes directly through bore 15 and out port 14 without passing through the filter material 13 itself, while a small portion of the exhaust gases are forced through the filter material 13 and apertures 12 due to the reduced size of the exit port 14 relative to the amount of gases passing into the filter housing 11. For example, for an exhaust pipe 99 with a diameter of 4 inches, the bore 15 and port 14 may be provided with a diameter of 3 inches, thereby forcing a portion of the exhaust gas through the filter material 13. In this case, the combined open area of the apertures 12 will exceed the difference between the open area of the 4 inch exhaust pipe 99 and the open area of the 3 inch port 14 in order to account for blockage by the filter material 13.

In still another alternative embodiment shown in FIG. 3, the filter device 10 may be provided with means 20 for adjusting the size of the exit port 14. This valve means 20 may be structured in various known manner, and as illustrated in FIG. 3 for example may comprise a rotatable gate member 21 that can be moved to increase or decrease the size of the exit port 14. The flow rate of the adjustable filter device 10 can be altered in response to a decrease or increase in engine exhaust gas flow rate or to an increase in blockage resulting from saturation of the filter material 13 over time, for example.

In still another alternative embodiment as shown in FIG. 4, the housing 11 of the filter device 10 may comprise a fabric or mesh, closed-end, outer member 31 disposed upon a perforated or apertured inner sleeve member 32 connected to the end of the exhaust pipe 99, with the filter material 13 disposed therebetween. Alternatively, if the exhaust pipe 99 is apertured or perforated, the fabric or mesh outer member 31 may be mounted directly to the exhaust pipe 99.

This construction provides a convenient easy mechanism for periodically replacing the filter material 13, and the fabric outer member 31 if needed. The methodology comprises the step of providing a filter device 10 as described above, the filter device 10 absorbing only a minor portion of the carbon dioxide within the exhaust gases. The filter device 10 is structured such that the exhaust flow is not significantly impeded by the filter material, and most preferably is structured such that the exhaust flow remains equal to original flow rate. Furthermore, by absorbing only a minor portion of the carbon dioxide, the life of the filter device 10 is dramatically lengthened. The proper structure is chosen by determining the flow rate of the exhaust gas passing from the exhaust pipe 98 and determining the flow rate of the exhaust gas passing through the carbon dioxide filter 10 after it has been mounted onto the exhaust pipe 98. Likewise, the original concentration of carbon dioxide in the exhaust gas is measured and the concentration of carbon dioxide in the exhaust gas having passed through a filter 10 is measured. The number and size of the apertures 12 and the density of the carbon dioxide filter material 13 are then chosen such that the flow rate of the exhaust gas is not reduced by the filter 10 and such that no more than 20 percent of the carbon dioxide is removed from the exhaust gas.

The filter device 10 may be structured such that the filter material 13 is removable for replacement by new or regenerated filter material, such as by providing access means (not shown), or the filter device 10 may be structured to be disposable after the filter material 13 has become saturated with entrapped carbon dioxide. The filter device 10 may be generally linear as shown, angled or even designed with a 90 degree bend dependent on the particular exhaust system to which it is to be attached. The filter device 10 may be built into the original exhaust system or provided as an after-market or add-on accessory.

It is understood that equivalents and substitutions for certain elements set forth above may be obvious to those of ordinary skill in the art, and therefore the true scope and definition of the invention is to be as set forth in the following claims.

We claim:

1. A method of removing carbon dioxide from the exhaust gas of a motor vehicle, the method comprising the steps of:

providing a carbon dioxide filter having a housing adapted to be mounted onto the exhaust pipe of a motor vehicle, said exhaust pipe having an exit opening with a diameter defining an open area, and a quantity of carbon dioxide filter material retained within said housing, said housing comprising a plurality of apertures, wherein the combined open area of said apertures is greater than the open area of said exit opening of said exhaust pipe;

mounting said carbon dioxide filter onto said exhaust pipe;

whereby the density of said carbon dioxide filter material and the combined open area of said apertures is chosen such that the flow rate of exhaust gas passing from said exhaust pipe through said filter is not reduced by said filter and such that no more than 20 percent of the carbon dioxide in said exhaust gas is retained by said filter.

2. The method of claim 1, further comprising the steps of:

determining the concentration of carbon dioxide in said exhaust gas passing through said exhaust pipe prior to said mounting step; and determining the concentration of said carbon dioxide in said exhaust gas passing through said carbon dioxide filter.

3. The method of claim 1, further comprising the steps of;

determining the flow rate of the exhaust gas passing from said exhaust pipe prior to the mounting step; and determining the flow rate of the exhaust gas passing through said carbon dioxide filter after said mounting step.

4. The method of claim 3, further comprising the steps of:

determining the concentration of carbon dioxide in said exhaust gas passing through said exhaust pipe prior to said mounting step; and determining the concentration of said carbon dioxide in said exhaust gas passing through said carbon dioxide filter.

5. The method of claim 1, further comprising the steps of:

providing said housing with a bore and an exit port, said exit port defining an open area being of greater dimension than any of said apertures and of lesser dimension than said open area of said exit opening of said exhaust pipe, wherein the combined open area of said apertures and said exit port is greater than the open area of said exit opening of said exhaust pipe.

6. The method of claim 5, further comprising the step of:

providing said housing with an adjustable gate member, whereby the open area of said exit port can be increased or decreased by adjusting said gate member;

and adjusting said gate member as needed to prevent reduction of the flow rate of the exhaust gas passing through said filter.

* * * * *